US005232616A

United States Patent [19]

Harrison et al.

[11] Patent Number: 5,232,616

[45] Date of Patent: Aug. 3, 1993

[54] LUBRICATING COMPOSITIONS

[75] Inventors: James J. Harrison, Novato; Curtis B. Campbell, Hercules, both of Calif.

[73] Assignee: Chevron Research and Technology Company, San Francisco, Calif.

[21] Appl. No.: 570,581

[22] Filed: Aug. 21, 1990

[51] Int. Cl.[5] ..... C10M 133/44; C10M 133/58

[52] U.S. Cl. ..... 252/51.5 A; 252/41

[58] Field of Search ..... 252/51.5 A, 41

[56] References Cited

U.S. PATENT DOCUMENTS

| | | | |
|---|---|---|---|
| 2,628,942 | 2/1953 | Morris et al. | 252/49.7 |
| 3,018,250 | 1/1962 | Anderson, et al. | 252/51.5 |
| 3,024,195 | 3/1962 | Drummond et al. | 252/51.5 |
| 3,163,603 | 12/1964 | Le Suer | 252/33.6 |
| 3,172,892 | 3/1965 | Le Suer et al. | 260/326.5 |
| 3,202,678 | 8/1965 | Stuart et al. | 260/326.5 |
| 3,215,707 | 11/1965 | Rense et al. | 260/326.3 |
| 3,216,936 | 11/1965 | Le Suer | 252/32.7 |
| 3,219,666 | 11/1965 | Norman et al. | 260/268 |
| 3,231,587 | 1/1966 | Rense | 260/346.8 |
| 3,254,025 | 5/1966 | Le Suer | 252/32.7 |
| 3,272,746 | 9/1966 | LeSuer et al. | 252/47.5 |
| 3,351,552 | 11/1967 | Le Suer | 252/41 |
| 3,361,673 | 1/1968 | Stuart et al. | 252/51.5 |
| 3,367,864 | 2/1968 | Elliott et al. | 252/32.7 |
| 3,556,995 | 1/1971 | Lee et al. | 252/39 |
| 3,634,240 | 1/1972 | O'Halloran | 252/32.7 |
| 3,666,662 | 5/1972 | Lowe | 252/33.6 |
| 3,764,536 | 10/1973 | Hellmuth et al. | 252/49.7 |
| 3,912,764 | 10/1975 | Palmer | 260/346.8 |
| 4,011,167 | 3/1977 | Chibnik et al. | 252/42.7 |
| 4,012,330 | 3/1977 | Brewster | 252/33.6 |
| 4,234,435 | 11/1980 | Meinhardt et al. | 252/51.5 |
| 4,471,091 | 9/1984 | Hayashi | 525/71 |
| 4,734,212 | 3/1988 | Harrison | 252/515 R |

FOREIGN PATENT DOCUMENTS

| | | |
|---|---|---|
| 0113157 | 11/1984 | European Pat. Off. . |
| 0311319 | 4/1989 | European Pat. Off. . |
| 48-61506 | 8/1973 | Japan . |
| WO89/11519 | 11/1989 | PCT Int'l Appl. . |
| WO90/15124 | 12/1990 | PCT Int'l Appl. . |

OTHER PUBLICATIONS

Chemical Abstracts, vol. 79, No. 22, Abstract No. 1279640 (Dec. 3, 1973).

*Primary Examiner*—Ellen McAvoy

*Attorney, Agent, or Firm*—L. S. Squires; W. K. Turner

[57] ABSTRACT

Provided are lubricating oil compositions which contain (a) a mixture comprising an oil-soluble alkali metal compound and certain polyalkenyl succinimide or (b) alkali metal salts of said polyalkenyl succinimides.

5 Claims, No Drawings

LUBRICATING COMPOSITIONS

BACKGROUND OF THE INVENTION

1. Field of the Invention

This invention relates to lubricating oil compositions which contain (a) a mixture comprising an oil-soluble alkali metal compound and certain polyalkenyl succinimides or (b) alkali metal salts of said polyalkenyl succinimides.

2. Description of the Prior Art

Mono-succinimides and bis-succinimides, especially those prepared by reacting a polyalkenyl succinic anhydride with various polyamines, are excellent dispersants in lubricating oil compositions. They aid in the dispersal of sludge, varnish, soot and other harmful contaminants in engines.

It has now been discovered that when certain of these polyalkenyl succinimides are employed in lubricating oil compositions in admixture with oil-soluble alkali metal compounds, or as alkali metal salts, the performance of the polyalkenyl succinimides is improved.

SUMMARY OF THE INVENTION

In accordance with the present invention there are provided lubricating compositions comprising a major amount of oil of lubricating viscosity and a minor amount of an oil-soluble composition selected from the group consisting of:

A. an alkali metal salt of a polyalkenyl succinimide which is the reaction product of
   (a) a polyalkenyl succinic acid or polyalkenyl succinic anhydride, with
   (b) an amine selected from the group consisting of polyamines and hydroxy-substituted polyamines; and B. a mixture comprising:
   1. an oil-soluble alkali metal compound; and
   2. a polyalkenyl succinimide which is the reaction product of
      (a) a polyalkenyl succinic acid or polyalkenyl succinic anhydride, with
      (b) an amine selected from the group consisting of polyamines and hydroxy-substituted polyamines;

wherein the polyalkenyl succinic acid and polyalkenyl succinic anhydride are prepared by a thermal reaction, and the lubricating composition has a basic nitrogen content of at least 0.02 wt. % and contains from about 5 to about 30 mmoles alkali metal/kg of lubricating composition.

In accordance with the present invention there is further provided a composition comprising an alkali metal salt of a polyalkenyl succinimide which is the reaction product of (a) a polyalkenyl succinic acid or polyalkenyl succinic anhydride, with
(b) an amine selected from the group consisting of polyamines and hydroxy-substituted polyamines;

wherein the polyalkenyl succinic acid and polyalkenyl succinic anhydride are prepared by a thermal reaction.

The invention further provides a composition comprising a mixture of:

1. an oil-soluble alkali metal compound; and
2. a polyalkenyl succinimide which is the reaction product of (a) a polyalkenyl succinic acid or polyalkenyl succinic anhydride, with
(b) an amine selected from the group consisting of polyamines and hydroxy-substituted polyamines;

wherein the polyalkenyl succinic acid and polyalkenyl succinic anhydride are prepared by a thermal reaction.

DESCRIPTION OF PREFERRED EMBODIMENTS

The polyalkenyl succinic acids and anhydrides employed in the present invention are obtainable from the reaction of maleic anhydride or maleic acid and a polyalkene containing at least one carbon-carbon double bond capable of reacting with the maleic anhydride or maleic acid. As discussed below, the polyalkenyl succinic acids and anhydrides of the present invention are limited to those which have been prepared by a thermal reaction, i.e., by heating approximately equivalent portions of maleic anhydride and the polyalkene at a temperature of, for example, about 100° C.–250° C. in the absence of halogen.

The principal sources of the polyalkenyl radical include olefin polymers, particularly polymers made from mono-olefins having from 2 to about 30 carbon atoms. Especially useful are the polymers of 1-mono-olefins such as ethylene, propene, 1-butene, and isobutene. Polymers of isobutene are preferred.

Also useful are the interpolymers of olefins such as those illustrated above with other interpolymerizable olefinic substances such as aromatic olefins, cyclic olefins, and polyolefins. Such interpolymers include, for example, those prepared by polymerizing isobutene with styrene, isobutene with butadiene, propene with isoprene, isobutene with p-methylstyrene, 1-heptene with 1-pentene, isobutene with styrene and piperylene, isobutene with propylene, butene with propylene, ethylene with propylene, etc.

The relative proportions of the mono-olefins to the other monomers in the interpolymers influence the stability and oil solubility of the products made from them. Thus, for reasons of oil solubility and stability, the interpolymers contemplated for use in this invention should be substantially aliphatic and substantially saturated, i.e., they should contain at least about 80% and preferably at least about 95% on a weight basis, of units derived from the aliphatic mono-olefins and no more than about 5% of olefinic linkages based on the total number of carbon-to-carbon covalent linkages. In most instances, the percent of olefinic linkages should be less than about 2% of the total number of carbon-to-carbon covalent linkages.

In addition to the pure polyalkenyl substituents described above, it is intended that the term "polyalkenyl" as used in this specification and in the claims, include those materials which are substantially polyalkenyl. As used herein, the term "substantially polyalkenyl" means that the polyalkenyl group contains no non-hydrocarbyl substituents or non-carbon atoms which significantly affect the polyalkenyl properties of such polyalkenyl substituents relative to their uses in this invention. For example, a polyalkenyl substituent may contain one or more ether, oxo, nitro, thia, carbohydrocarbyloxy, or other non-hydrocarbyl groups as long as these groups do not significantly affect the polyalkenyl characteristics of the substituent.

Another important aspect of this invention is that the polyalkenyl substituent of the polyalkenyl succinic compound should be substantially saturated, i.e., at least about 95% of the total number of carbon-to-carbon covalent linkages should be saturated linkages. An excessive proportion of unsaturated linkages renders the molecule susceptible to oxidation, deterioration, and polymerization and results in products unsuitable for use in hydrocarbon oils in many applications.

The size of the polyalkenyl substituent of the succinic compound appears to determine the effectiveness of the additives of this invention in lubricating oils. It is important that said substituent be large, that is, that it have a molecular weight within the range of about 700 to about 100,000. Olefin polymers (i.e., polyalkenes) having a molecular weight of about 750 to 5000 are preferred. However, higher molecular weight olefin polymers having molecular weights from about 10,000 to about 100,000 are also useful and impart viscosity index improving properties to the compositions of this invention. In many instances, the use of such higher molecular weight olefin polymers is desirable.

The most common sources of these polyalkenes are the polyolefins such as polyethylene, polypropylene, polyisobutene, etc. A particularly preferred polyolefin is polyisobutene having a molecular weight from about 900 to about 1400.

In general, polyalkenyl succinic acids and anhydrides can be prepared by two different types of reactions or processes. The first type of reaction or process involves either pre-reacting the polyalkene with a halogen, e.g., chlorine, and reacting the halogenated polyalkene with maleic acid or anhydride, or contacting the polyalkene and maleic anhydride or acid in the presence of a halogen, e.g., chlorine. This type of reaction or process is known in the art as the "chlorination" reaction and is described in U.S. Pat. No. 3,172,892, issued Mar. 9, 1965 to LeSuer et al., which is hereby incorporated by reference herein in its entirety. The second type of reaction or process which may be used to prepare polyalkenyl succinic anhydrides or acids involves simply contacting the hydrocarbon and the maleic anhydride or acid (in the absence of halogen) at an elevated temperature. This type of reaction or process is known in the art as the thermal reaction. For the purposes of this specification and claims, the terms "thermal process" and "thermal reaction" include processes such as that disclosed in U.S. Pat. No. 3,361,673, issued Jan. 2, 1968 to Stuart et al., which is hereby incorporated by reference in its entirety. In addition, U.S. Pat. No. 3,912,764, issued Oct. 14, 1975 to Palmer, involves a combination of the thermal and chlorination processes, as by reacting a substantial portion of the hydrocarbon and maleic anhydride or acid by the thermal process and then completing the reaction via a chlorination reaction. U.S. Pat. No. 3,912,764 is also incorporated by reference herein in its entirety.

The distinction between the polyalkenyl succinic anhydrides and acids prepared by the thermal reaction and those prepared by the chlorination process is a critical one for the purposes of this invention. It has quite surprisingly been found that the performance of lubricating oil additives made from polyalkenyl succinic anhydrides and acids which have been prepared via a thermal reaction can be improved dramatically when they are in the presence of alkali metal (either in admixture with an oil-soluble alkali metal compound or as the salt of an alkali metal compound), whereas the performance of additives made from polyalkenyl anhydrides or acids prepared via the chlorination process is not improved by the presence of an alkali metal compound. Since the essence of this invention is the improvement of the performance of lubricating oil additives and the lubricating oils which contain them, the additives of this invention are limited to those derived from polyalkenyl succinic anhydrides or acids made via the thermal reaction. Since the performance of lubricating oil additives containing polyalkenyl succinic anhydrides and acids made by the chlorination process is not improved by the presence of an alkali metal compound, they accordingly, do not form part of this invention.

The amines useful for reacting with the polyalkenyl succinic anhydrides and acids of this invention are characterized by the presence within their structure of at least two H-N< groups. Mixtures of two or more amines can be used in the reaction with one or more of the polyalkenyl succinic anhydrides or acids of the present invention. Preferably, the amine contains at least one primary amino group (i.e., $-NH_2$).

One group of amines suitable for use in this invention are branched polyalkylene polyamines. The branched polyalkylene polyamines are polyalkylene polyamines wherein the branched group is a side chain containing on the average at least one nitrogen-bonded aminoalkylene

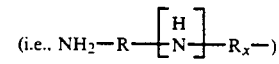

group per nine amino units present on the main chain, for example, 1 to 4 of such branched chains per nine units on the main chain, but preferably one side chain unit per nine main primary amino groups and at least one tertiary amino group.

These reagents may be expressed by the formula:

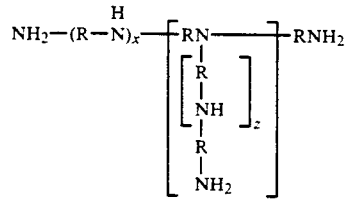

wherein R is an alkylene group such as ethylene, propylene, butylene and other homologs (both straight chained and branched), etc., but preferably ethylene; and x, y and z are integers, x being, for example, from 4 to 24 or more but preferably 6 to 18, y being, for example, 1 to 6 or more but preferably 1 to 3, and z being, for example, 0 to 6 but preferably 0 to 1. The x and y units may be sequential, alternative, orderly or randomly distributed.

Suitable amines also include polyoxyalkylene polyamines, e.g., polyoxyalkylene diamines and polyoxyalkylene triamines, having average molecular weights ranging from about 200 to 400 and preferably from about 400 to 2000. Illustrative examples of these polyoxyalkylene polyamines may be characterized by the formulae:

$$NH_2-(\text{Alkylene}-O-\text{Alkylene}-)_m NH_2$$

where m has a value of about 3 to 70 and preferably about 10 to 35; and $$R'-[(\text{Alkylene}-O-\text{Alkylene}-)_n NH_2]_{3-6}$$

wherein n is such that the total value is from about 1 to 40 with the proviso that the sum of all of the n's is from about 3 to about 70 and generally from about 6 to about 35, and R′ is a polyvalent saturated hydrocarbyl radical of up to 10 carbon atoms having a valence of 3 to 6. The alkylene groups may be straight or branched chains and contain from 1 to 7 carbon atoms, and usually from 1 to 4 carbon atoms. The various alkylene groups present within the above formulae may be the same or different.

Preferred amines are the alkylene polyamines, including the polyalkylene polyamines, as described in more detail hereafter. The alkylene polyamines include those conforming to the formula:

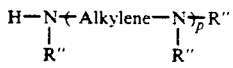

wherein p is from 1 to about 10; each R″ is independently a hydrogen atom, a hydrocarbyl group or a hydroxy-substituted hydrocarbyl group having up to about 30 atoms, and the "alkylene" group has from about 1 to about 10 carbon atoms. The preferred alkylene is ethylene or propylene. Especially preferred are the alkylene polyamines where each R″ is hydrogen with the ethylene polyamines and mixtures of ethylene polyamines being the most preferred. Usually p will have an average value of from about 2 to about 7. Such alkylene polyamines include methylene polyamines, ethylene polyamines, butylene polyamines, propylene polyamines, pentylene polyamines, hexylene polyamines, heptylene polyamines, etc. The higher homologs of such amines and related aminoalkyl-substituted piperazines are also included.

Alkylene polyamines useful in preparing the polyalkenyl succinimides include ethylene diamine, diethylene triamine, triethylene tetramine, propylene diamine, trimethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, N-(2-aminoethyl)piperazine, 1,4-bis(2-aminoethyl)piperazine, and the like. Higher homologs as are obtained by condensing two or more of the above-illustrated alkylene amines are useful as amines in this invention as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in *The Encyclopedia of Chemical Technology*, Second Edition, Kirk and Othmer, Volume 7, pages 27-39, Interscience Publishers, Division of John Wiley and Sons, 1965, which is hereby incorporated by reference for its disclosure of useful polyamines. Such compounds are prepared most conveniently by the reaction of an alkylene chloride with ammonia or by reaction of an ethylene imine with a ring-opening reagent such as ammonia, etc. These reactions result in the production of a somewhat complex mixtures of alkylene polyamines, including cyclic condensation products such as piperazines.

Hydroxyalkyl alkylene polyamines having one or more hydroxyalkyl substituents on the nitrogen atoms, are also useful in preparing compositions of the present invention. Preferred hydroxyalkyl-substituted alkylene polyamines are those in which the hydroxyalkyl group is a lower hydroxyalkyl group, i.e., having less than 8 carbon atoms. Examples of such hydroxyalkyl-substituted polyamines include N-(2-hydroxyethyl)ethylene diamine, N,N-bis(2-hydroxyethyl)ethylene diamine, 1-(2-hydroxyethyl)-piperazine, monohydroxypropyl-substituted diethylene triamine, dihydroxypropyl-substituted tetraethylene pentamine, N-(3-hydroxybutyl)tetramethylene diamine, etc. Higher homologs as are obtained by condensation of the above-illustrated hydroxyalkylene polyamines through amino radicals or through hydroxy radicals are likewise useful as amines in this invention. Condensation through amino radicals results in a higher amine accompanied by removal of ammonia and condensation through the hydroxy radicals results in products containing ether linkages accompanied by removal water.

Other suitable amines which may be used to prepare the polyalkenyl succinimides useful in the present invention include those disclosed in U.S. Pat. No. 4,234,435, issued Nov. 18, 1980 to Meinhardt et al., which is hereby incorporated by reference herein in its entirety.

To form the reaction product of the polyalkenyl succinic anhydride or acid and the above-described amines, one or more amines are heated, optionally in the presence of a normally liquid, substantially inert organic liquid solvent/diluent, at temperatures in the range of about 80° C. up to the decomposition point (the decomposition point is the temperature at which there is sufficient decomposition of any reactant or product such as to interfere with the production of the desired product) but normally at temperatures in the range of about 100° C. to about 300° C., provided 300° C. does not exceed the decomposition point. Temperatures of about 125° C. to about 250° C. are normally used. The polyalkenyl succinic anhydride or acid and the amine are reacted in amounts sufficient to provide from about 0.3 to about 1.0 mole of polyamine per mole of polyalkenyl succinic anhydride or acid, preferably from about 0.5 to about 0.9 mole of polyamine per mole of polyalkenyl succinic anhydride or acid.

It has been found that the amount of basic nitrogen in the lubricating compositions of the present invention is critical to their performance. Lubricating compositions having a basic nitrogen content of less than about 0.02 wt. % based on the weight of the entire lubricating composition (including the oil), do not exhibit improved performance in the presence of alkali metal, whereas lubricating compositions having a basic nitrogen content of at least about 0.02 wt. % do exhibit improved performance.

The oil-soluble compositions employed in the lubricating compositions of the present invention also contain alkali metal. This alkali metal may be present in one of two ways. It may either be present as an oil-soluble alkali metal compound which is in admixture with the above-described polyalkenyl succinimide, or it may be present in the form of an alkali metal salt of said polyalkenyl succinimide.

Any alkali metal may be used in the practice of this invention, with lithium, sodium and potassium being preferred. When the alkali metal is introduced into the lubricating oil additive as an oil-soluble alkali metal compound, a wide variety of such compounds may be used, it being required only that the compound be soluble in oil and provide the improved performance referred to above. Examples of such compounds include, but are not limited to, sodium sulfonates, sodium alkylphenols, sodium sulfurized alkylphenols, sodium dithiophosphate, sodium salts of Mannich Bases, sodium salts of $C_9$ alkylated hydroxybenzylglycine, and the like. Preferred oil-soluble alkali metal compounds are alkali metal sulfonates such as sodium sulfonates.

The alkali metal may also be present in the compositions of the present invention in the form of the cation of an alkali metal salt of the polyalkenyl succinimides of this invention. In this case, the polyalkenyl succinimide is reacted with an alkali metal compound, prior to its addition to the lubricating oil, to form the corresponding alkali metal salt. Alkali metal compounds suitable as such reactants include any alkali metal compound that will react with the polyalkenyl succinimide to produce an alkali metal salt thereof. Examples of such alkali metal compounds include, but are not limited to, alkali metal hydroxides, such as LiOH, NaOH and KOH; alkali metal methoxides, such as sodium methoxide, lithium methoxide and potassium methoxide; and alkali metal carbonates, such as lithium carbonate, sodium carbonate and potassium carbonate.

In general, it is required only that there be an amount of alkali metal in the compositions of this invention which is sufficient to improve the performance of the polyalkenyl succinimide in lubricating oils. Thus, the amount of alkali metal in the lubricating composition (whether present as an oil-soluble compound or as the cation of an alkali metal salt of a polyalkenyl succinimide) can vary considerably. It has, however, been discovered that within this broad range, there is a critical lower limit to the amount of alkali metal which should be employed. If this minimum amount of alkali metal is not present, the improved performance provided by the combination of the polyalkenyl succinimide and alkali metal is not observed. Thus, the alkali metal is employed in the compositions of the present invention such that there is present in the lubricating composition at least about 5.0 mmoles of alkali metal/kg of lubricating composition. The upper limit on the amount of alkali metal in the lubricating compositions is not as critical as the lower limit. In general, this upper limit is determined by the desired ash content of the lubricating composition. Typically, up to about 50 mmoles of alkali metal/kg of lubricating composition are employed. The preferred amount of alkali metal in the composition is from about 5 to about 30 mmoles alkali metal/kg of lubricating composition.

It has quite surprisingly been found that when alkaline earth metals are used in place of the alkali metals of the present invention, the performance of the resulting lubricating oils is only slightly improved. Thus, for example, a lubricating oil composition which employs a polyalkenyl succinimide of this invention and a sodium sulfonate (i.e., a composition of this invention) has greatly improved properties, whereas a lubricating oil composition containing the same polyalkenyl succinimide and a calcium sulfonate shows only slight improvement.

The lubricating compositions of this invention also contain at least one oil of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like.

Natural oils include animal oils and vegetable oils (e.g., castor oil, lard oil) as well as solvent-refined or acid-refined mineral lubricating oils of the paraffinic, naphthenic, or mixed paraffin-naphthenic types. Oils of lubricating viscosity derived from coal or shale are also useful base oils. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); alkyl benzenes [e.g., dodecylbenzenes, tetradecylbenzenes, dinonylbenzenes, di-(2-ethylhexyl)benzenes, etc.]; polyphenols (e.g., biphenyls, terphenyls, etc.); and the like. Alkylene oxide polymers and interpolymers and derivatives thereof where the terminal hydroxyl groups have been modified by esterification, etherification, etc., constitute another class of known synthetic lubricating oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500, etc ), or mono- and polycarboxylic esters thereof, for example, the acetic acid esters, mixed $C_1$–$C_8$ fatty acid esters, or the $C_{13}$ oxo acid diester of tetraethylene glycol. Another suitable class of synthetic lubricating oils comprises the esters of dicarboxylic acids (e.g., phthalic acid, succinic acid, maleic acid, azelaic acid, suberic acid, sebacic acid, fumaric acid, adipic acid, linoleic acid dimer, etc.), with a variety of alcohols (e.g., butyl alcohol, hexyl alcohol, dodecyl alcohol, 2-ethylhexyl alcohol, pentaerythritol, etc.). Specific examples of these esters include dibutyl adipate, di-(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting 1 mole of sebacic acid with 2 moles of tetraethylene glycol and 2 moles of 2-ethyl-hexanoic acid, and the like. Silicon-based oils such as the polyalkyl-, polyaryl-, polyalkoxy-, or polyaryloxy-siloxane oils and silicate oils comprise another useful class of synthetic lubricants [e.g., tetraethyl-silicate, tetraisopropyl-silicate, tetra-(2-ethylhexyl)-silicate, tetra-(4-methyl-2-tetraethyl)-silicate, tetra-(p-tert-butylphenyl)-silicate, hexyl-(4-methyl-2-pentoxy)-disiloxane, poly(methyl-siloxanes, poly(methylphenyl)-siloxanes, etc.]. Other synthetic lubricating oils include liquid esters of phosphorus-containing acids (e.g., tricresyl phosphate, trioctyl phosphate, diethyl ester of decane phosphonic acid, etc.), polymeric tetrahydrofurans, and the like.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Generally, the lubricants of the present invention contain an amount of the oil-soluble compositions of this invention sufficient to provide it with detergent/-dispersant properties. Normally, this amount will be from about 0.05% to about 20% preferably from about 1.0% to about 10%, of the combined weight of the lubricating oil and the oil-soluble composition of the present invention. In lubricating oils operated under extremely adverse conditions, such as lubricating oils for marine diesel engines, the oil-soluble compositions of this invention may be present in amounts of up to about 30% by weight.

The invention also contemplates the use of other additives in combination with the oil-soluble compositions of this invention. Such additives include, for example, auxiliary detergents and dispersants of the ash-producing or ashless type, corrosion- and oxidation-inhibiting agents, viscosity improving agents, extreme pressure agents, color stabilizers and anti-foam agents.

EXAMPLE A

In this example, a commercial polyalkenyl mono-succinimide, which is the reaction product of polyisobutene succinic anhydride ("PIBSA") with an alkylene polyamine, was prepared by the thermal reaction disclosed in U.S. Pat. No. 3,361,673.

EXAMPLE B

In this example, a commercial polyalkenyl mono-succinimide, which is the reaction product of PIBSA and an alkylene polyamine, was prepared by the chlorination process disclosed in U.S. Pat. No. 3,172,892.

Examples C–E illustrate the preparation, by a thermal reaction, of polyalkenyl succinimides which are the reaction products of PIBSA and a polyamine.

EXAMPLE C

A product was prepared following the procedure of Example A, except that diethylenetriamine was used as the polyamine, and the charge mole ratio of polyamine to polyalkenyl succinic anhydride was 0.5.

EXAMPLE D

A product was prepared as in Example C, except that a "heavy polyamine," a mixture of polyethyleneamines sold by Union Carbide Co. under the designation Polyamine HPA-X, was used instead of diethylenetriamine.

EXAMPLE E

A product was prepared as in Example C, except that the polyamine was tri(aminoethyl) amine and the charge mole ratio of polyamine to polyalkenyl succinic anhydride was 0.33.

Examples F–M illustrate the preparation of various oil-soluble alkali metal and alkaline earth metal compounds.

EXAMPLE F

To a 2 Liter 3-necked flask was added 600 g of a propylene tetramer-substituted phenol and 350 ml methanol To this was added 60 g sodium methoxide and the mixture was stirred at reflux for 4 hours. Then the methanol was removed in vacuo. The product was then dissolved in heptane, heated and filtered through silica gel to remove any unreacted sodium methoxide. The heptane was removed in vacuo. The product, the sodium salt of the alkylphenol had a sodium content of about 1% by weight.

EXAMPLE G

To a solution of 571.7 g sulfurized alkylphenol (prepared by reacting a propylene tetramer alkylated phenol with lime resulting in 60% neutralization of the phenolic hydroxyl groups) in 600 ml toluene was added 11.9 g (517 mmol) sodium metal in pieces with stirring under a nitrogen sweep at room temperature. This took a total of 90 minutes. The reaction was then allowed to stir at room temperature overnight. Then this was filtered through a sintered glass buchner funnel under vacuum. The product was then diluted with toluene and refiltered and the toluene was removed in vacuo. A total of 572.3 g product was obtained. This contained 1.32% sodium and 7.4% sulfur.

EXAMPLE H

To a 3-necked flask equipped with a stirrer, thermometer, condenser and a vent line to a u-tube bubbler, was added 782 g dithiophosphonic acid made from 2-ethylhexanol, and a mixture of 400 ml acetone and 400 ml hexane. To this was added 165.48 g sodium carbonate (anhydrous) through a powder funnel. Gradually the temperature was increased to reflux and gas was given off. After 5 hours the reaction was cooled overnight. Then the mixture was filtered. The pH of the filtrate was about 5–6. The filtrate was then dried over anhydrous sodium sulfate for 1-hour then filtered. The solvent was removed in vacuo to give 730.6 g product. This product was dried further by dissolving in toluene and heating to reflux using a Dean Stark trap. The toluene was then removed to give a product that was analyzed to contain 7.8% sodium, 7.3% phosphorus, and 14.9% sulfur.

EXAMPLE I

To a 3-neck round bottom flask equipped with an overhead stirrer and Dean Stark trap was added 634.7 g polyisobutenylsuccinic anhydride and 400 ml xylene. This was heated to reflux and to this was added 18.9 g sodium methoxide. Upon addition foaming occurred. After stirring at reflux for about 2 hours the reaction was cooled and the xylene was removed in vacuo. A total of 661.2 g of product was obtained. The product had a sodium content of about 1%.

EXAMPLE J

To a 3-neck round bottom flask equipped with an overhead stirrer and nitrogen inlet tube was added 297.4 g of a Mannich Base (a C18-alkylated phenol reaction product with methylamine and formaldehyde) dissolved in 300 ml toluene. To this was added 9.2 g metallic sodium in small pieces. This was stirred vigorously for 14 days under nitrogen. Then the reaction was filtered through a sintered glass buchner funnel and the toluene was removed in vacuo. A total of 312.6 g product was obtained with a sodium content of 2.6% by weight.

EXAMPLE K

A sodium salt of $C_9$ alkylated hydroxybenzylglycine was prepared according to Example 12 of U.S. Pat. No. 4,387,244.

EXAMPLE L

A calcium salt of $C_9$ alkylated hydroxybenzylglycine was prepared as described in Example 1 of U.S. Pat. No. 4,612,130, except that a calcium salt was made, rather than the sodium salt of said Example 1.

EXAMPLE M

A magnesium salt of $C_9$ alkylated hydroxybenzylglycine was prepared as described in Example 1 of U.S. Pat. No. 4,612,130, except that a magnesium salt was made rather than the sodium salt of said Example 1.

EXAMPLE 1

This example illustrates the preparation of an oil-soluble alkali metal salt of a polyalkenyl succinimide of the present invention.

To a 12 Liter, 3-neck flask equipped with an overhead stirrer and a nitrogen inlet tube was added 5000 g of a bis(tetraethylenepentaamine) succinimide made from polybutene (MW 950) via a thermal process similar to that described in Example A. To the resulting product was added 80 g of a 50% sodium hydroxide aqueous solution. The resulting mixture was heated at 160° C. for 5 hours. A total of 45 ml water was removed during that time. The resulting product had a viscosity at 100° C. of 110.5 centistokes.

EXAMPLE 2

This example illustrates the preparation of an oil-soluble alkali metal salt of a polyalkenyl succinimide of the present invention.

A composition was prepared as described in Example 1 (using a bis(tetraethylenepentaamine) succinimide made via a thermal process) except that lithium hydroxide was used instead of sodium hydroxide.

EXAMPLE 3

Lubricating oil compositions were prepared in a conventional manner containing an oil of lubricating viscosity, an antioxidant, an antiwear additive and 8 wt. % of each in turn the additives indicated in Table I below. These compositions were then subjected to the Caterpillar 1K (D69-1) test, with the results indicated in Table I.

TABLE I

| CATERPILLAR 1K (D69-1) TEST WD-1 RATINGS | | | |
|---|---|---|---|
| Composition from Example | Test A | Test B | Average Weighted Demerits |
| A | 533.4 | 408.7 | 471.1 |
| 1 | 183.7 | 362.3 | 273.0 |
| 2 | 310.5 | 297.7 | 304.1 |

The data in Table I shows that the sodium and lithium salts of thermally prepared polyisobutenyl succinimide from Examples 1 and 2, respectively, provide improved performance over thermally prepared polyisobutenyl succinimide (from Example A) in the absence of alkali metal.

In the following examples the dispersants were blended into the lubricating oil compositions on an equal polybutene basis to an 8 wt. % dispersant level based on 8 wt. % of the material made in Example A. For example, the material of Example A contains approximately 32.7% polybutene by weight in a typical sample. The amount of succinimide used in the examples contained varying amounts of polybutene. The amount of each succinimide to be used in each example was calculated as follows:

$$\frac{8\% \times 32.7\%}{\%\ \text{Polybutene}} = \%\ \text{dispersant to be used}$$

This calculation gave 4.65% for the material prepared in Example C, 4.64% for the material prepared in Example E and 5.12% for the material prepared in Example D.

EXAMPLE 4

This example illustrates the performance of lubricating oil compositions containing a thermally prepared polyisobutenyl succinimide and compositions containing a mixture of a thermally prepared polyisobutenyl succinimide and an oil-soluble alkali metal compound. Also illustrated is the performance of lubricating oil additives having varying basic nitrogen contents.

Lubricating oil compositions similar to those of Example 3 were prepared in a conventional manner containing each in turn of the additives indicated in Table II below. These compositions were tested using the 60-hour Caterpillar 1G2 test, with the results being indicated in Table II.

TABLE II

| Composition from Example, Wt. %[5] | Calculated Wt. %[5] Basic Nitrogen | WTD[1] | TGF, %[2] | LPD[3] | UCD[4] |
|---|---|---|---|---|---|
| Ex. A, 8% | 0.100 | 350 | 74 | 179 | 335 |
| Ex. C, 4.65% | 0.018 | 316 | 63 | 30 | 185 |
| Ex. C, 4.65% Sodium sulfonate (Ex. F), 1% | 0.018 | 368 | 69 | 58 | 170 |
| Ex. E, 4.64% | 0.013 | 333 | 70 | 28 | 263 |
| Ex. E, 4.64% Sodium sulfonate (Ex. F), 1% | 0.013 | 582 | 71 | 133 | 118 |
| Ex. D, 5.12% | 0.106 | 513 | 73 | 165 | 353 |
| Ex. D, 5.12% Sodium sulfonate (Ex. F, 1% | 0.106 | 348 | 81 | 69 | 219 |

[1]WTD = weighted total demerits
[2]TGF = top groove fill
[3]LPD = lower piston deposits
[4]UCD = undercrown deposits
[5]Percentages are wt. % based on the weight of the lubricating composition.

In Table II, the lower piston deposit and undercrown deposit results are considered to be the most significant measurement of performance.

The data in Table II show that lubricating oil compositions containing a mixture of a thermally prepared polyalkenyl succinimide and an oil-soluble alkali metal compound outperform lubricating oil compositions containing the succinimide but no alkali metal compound provided that the lubricating compositions had a basic nitrogen content of at least about 0.02 wt. %.

EXAMPLE 5

This example illustrates that a variety of oil-soluble alkali metal compounds can be used in the practice of this invention.

A baseline lubricating oil composition similar to that of Example 3 was prepared in a conventional manner.

In turn, each of the additives indicated in Table III below was added to the baseline formulation and the resulting lubricating oil composition was tested by the 60-hour Caterpillar 1G2 test. The results are indicated in Table III.

TABLE III

| | 60-Hour, 1G2 Results | | | | |
|---|---|---|---|---|---|
| Wt. % Additive | Metal Content[6] | WTD | TGF. % | LPD | UCD |
| Baseline formulation | 0 | 402 | 68 | 133 | 351 |
| 1% Ca sulfonate (Ex. G) | 50.0[7] | 368 | 69 | 96 | 114 |
| Commercially available sodium salt of an alkyl-aromatic sulfonate | 10.2 | 344 | 76 | 36 | 47 |
| 2% Na alkylphenol (Ex. F) | 8.96 | 312 | 69 | 45 | 65 |
| 1.5% Na sulfurized alkylphenol (Ex. G) | 8.61 | 305 | 68 | 33 | 30 |
| 1% Na dithio-phosphate (Ex. H) | 21.74 | 344 | 75 | 89 | 45 |
| Na dithiophosphate[8] (Ex. H) | 22.0 | 431 | 64 | 65 | 53 |
| 1% Na PIBSA (Ex. I) | 4.78 | 339 | 71 | 129 | 14 |
| Na dithiophosphate[8] (Ex. H) | 32.1 | 361 | 75 | 51 | 66 |
| 0.7% Na Mannich Base (Ex. J) | 7.91 | 344 | 80 | 39 | 58 |
| 1% Na (C[9]HBG)[9] (Ex. K) | — | 294 | 78 | 34 | 40 |
| 1% Ca (C[9]HBG) (Ex. L) | — | 387 | 62 | 129 | 256 |
| 1% Mg (C[9]HBG) (Ex. M) | — | 426 | 54 | 92 | 480 |
| 1% C[9]HBG Acid | — | 447 | 75 | 113 | 163 |

[6]mmoles metal (Na, Ca or Mg)/kg polyalkenyl succinimide
[7]49.87 mmoles Ca + 0.13 mmoles Na
[8]sufficient material was used to provide the indicated metal content.
[9]HBG = hydroxybenzylglycine As in Table II, the lower piston deposit and under-crown deposit results are considered the most significant measurements of performance.

The data in Table III shows that a wide variety of oil-soluble alkali metal compounds are suitable for use in the present invention. It also demonstrates that, quite surprisingly, oil-soluble alkaline earth metal compounds do not significantly improve the performance of the baseline formulation whereas that alkali metal compounds do. Table III further shows that when the alkali metal content is less than about 5 mmoles alkali metal/kg of lubricating composition, no performance benefit is achieved.

EXAMPLE 6

This example compares the performances of lubricating oil compositions containing polyalkenyl succinimides made via the thermal process with those containing polyalkenyl succinimides made via the chlorination process.

A baseline lubricating oil composition similar to that of Example 3 was prepared in a conventional manner. To separate samples of this baseline oil was added, in turn, 8 wt. % of a polyisobutenyl mono-succinimide prepared via a thermal process (designated "Baseline Oil Th") and 8 wt. % of a polyisobutenyl mono-succinimide prepared via a chlorination reaction (designated "Baseline Oil Cl").

Both baseline formulations were tested in a 60-hour 1G2 test using the additives indicated in Table IV below.

TABLE IV

| | 60-Hour 1G2 Test Results | | | |
|---|---|---|---|---|
| Lubricating Composition | WTD | TGF. % | LPD | UCD |
| Baseline Oil Th | 384 | 70 | 128 | 291 |
| Baseline Oil Th 1% Ca sulfonate[10] (Ex. G) | 368 | 69 | 98 | 114 |
| Baseline Oil Th 1% Na sulfonate[11] (Ex. F) | 299 | 73 | 44 | 52 |
| Baseline Oil Cl | 520 | 76 | 222 | 225 |
| Baseline Oil Cl Ca sulfonate[12] (Ex. G) | 366 | 82 | 148 | 99 |
| Baseline Oil Cl Na sulfonate[12] (Ex. F) | 400 | 71 | 124 | 98 |

[10]commercially available calcium salt of an alkylaromatic sulfonate
[11]commercially available sodium salt of an alkylaromatic sulfonate
[12]sufficient material used to provide 10 mmoles metal/kg lubricating composition The data in Table IV shows that the alkali metal compounds perform as well as do the alkaline earth metal compounds with polyalkenyl succinimides prepared via the chlorination process, but that the alkali metal compounds' performance is superior to that of the alkaline earth metal compounds' when used with polyalkenyl succinimides prepared via a thermal process.

What is claimed is:

1. A lubricating composition comprising a major amount of oil of lubricating viscosity and a minor amount of an oil-soluble composition selected from the group consisting of:

A. an alkali metal salt of a polyalkenyl succinimide which is the reaction product of
  (a) a polyalkenyl succinic acid or polyalkenyl succinic anhydride, with
  (b) an amine selected from the group consisting of polyamines and hydroxy-substituted polyamines; and B. a mixture comprising:
  1. an oil-soluble alkali metal compound; and
  2. a polyalkenyl succinimide which is the reaction product of
    (a) a polyalkenyl succinic acid or polyalkenyl succinic anhydride, with
    (b) an amine selected from the group consisting of polyamines and hydroxy-substituted polyamines;

wherein the polyalkenyl succinic acid and polyalkenyl succinic anhydride are prepared by a thermal reaction, and the lubricating composition has a sufficient amount of basic nitrogen content so that the use of from 7.91 to about 50 mmoles of alkali metal/kg lubricant composition provides for reductions in the lower piston deposits as compared to the lubricant composition not containing alkali.

2. The lubricating composition of claim 1 wherein the alkali metal is selected from Na, Li and K.

3. The lubricating composition of claim 1 wherein the oil-soluble alkali metal compound is an alkali metal sulfonate.

4. The lubricating composition of claim 1 wherein the amine is selected from tetraethylenepentaamine and a heavy polyamine.

5. A lubricating composition according to claim 1 wherein the lubricant composition contains from 7.91 to about 30 mmoles of alkali metal/kg.

* * * * *